United States Patent [19]

Bilson

[11] Patent Number: 4,523,693

[45] Date of Patent: Jun. 18, 1985

[54] LUMINAIRE DOOR HINGE

[75] Inventor: Edward B. Bilson, Memphis, Tenn.

[73] Assignee: ITT Corporation, New York, N.Y.

[21] Appl. No.: 652,521

[22] Filed: Sep. 20, 1984

[51] Int. Cl.[3] ..... B65D 43/14; B65D 51/04

[52] U.S. Cl. ..... 220/337

[58] Field of Search ..... 220/334, 337, 338, 342, 220/343

[56] References Cited

U.S. PATENT DOCUMENTS 3,387,737 6/1968 Baldwin et al. ..... 220/337

*Primary Examiner*—George T. Hall

*Attorney, Agent, or Firm*—James B. Raden; Edward J. Brosius

[57] ABSTRACT

A door hinge for a luminaire is provided. The bezel section of the luminaire is affixed to the base section of the luminaire by such hinge. A hinge bar is affixed to an end of the bezel section, and a hinge plate is affixed to a base section of the luminaire. The hinge bar comprises an elongated bar of generally cylindrical cross section extending generally parallel to the end of the bezel section. The hinge plate comprises a hook shaped device generally flat in cross section and having a base section affixed to the luminaire base section, a curved middle section and a distal end section bent back toward the luminaire base section. The bezel section is rotatably mounted to the base section of the luminaire by the hinge. Upon the lifting of the bezel section, the hinge bar can be lifted from the hinge plate and the bezel section can be removed from the luminaire.

7 Claims, 3 Drawing Figures

LUMINAIRE DOOR HINGE

BACKGROUND OF THE INVENTION:

The present invention relates to a hinge assembly and, more particularly, to a hinge assembly for use in a luminaire to hold a bezel assembly in rotational contact therewith, while being able to remove said bezel assembly from said luminaire by separation of the hinge assembly.

The most widely known luminaire assemblies have a single hinge at the rear base of the luminaire. The bezel is mounted to this hinge and is rotatable away from the base upon opening of a latch at the other end of the luminaire. The bezel is a fairly large assembly in such applications as it includes the refractor and a metal section that covers the ballast, starter and other electrical elements of the luminaire. Such bezel, when opened, exposes all the electrical elements of the luminaire. Accordingly, it is desired to have a luminaire with a separate door covering the electrical components of the luminaire and a bezel door including the refractor. Such luminaires are known and permit the opening of only the bezel door to replace a bulb or refractor lens, while the separate door covering the electrical components of the luminaire need not be opened.

When opening the bezel door of a luminaire, it is desirable that the bezel remain hinged to the luminaire to prevent the bezel from falling from the luminaire. This is especially true in luminaires used in street lighting applications, where the luminaire is mounted several meters above ground. The bezel is usually opened along its hinges to change the lamp. However, under certain conditions it is desired to open the bezel and then remove bezel from the luminaire. Such conditions would include the replacement of the refractor or the reflector. Certain bezel hinges are known that have crimped hinge plates and would not permit such removal of the bezel.

Accordingly, it is an object of the present invention to provide a hinge assembly for a bezel whereby the bezel is rotatably mounted to a luminaire, yet is removable from the luminaire.

SUMMARY OF THE INVENTION

The present invention provides a hinge assembly for use in mounting a bezel to a luminaire. Usually two hinge members are utilized along the mounting axis between the bezel and luminaire. However, one hinge member could be designed to perform the desired hinge function. Each hinge comprises a hinge bar of a generally cylindrical, elongated shape affixed to an end of the bezel. The hinge bar extends generally parallel to the axis joining the luminaire and the bezel. The hinge bar is usually supported at each end by a frame support that extends to and is affixed to the bezel section of the luminaire. Accordingly, the middle section of the hinge bar is free to contact and be retained by the hinge plate.

Each hinge plate comprises an extension of a portion of the luminaire base. The protruding portion forming the hinge plate is of a generally flat cross section. The base section of the hinge plate is either affixed to or actually forms a part of the luminaire base. A middle section of the hinge plate is curved back away from the bezel toward the base section of the luminaire which is toward the rear of the luminaire. The distal end portion of the hinge plate is, accordingly, bent back toward the rear of the luminaire. The amount that the hinge plate is bent and curved is carefully controlled so that the bezel hinge bar is able to be assembled into and rotated in the hinge plate. Typically such bending back to the distal end of the hinge plate is done through an angle of 120°–180° with the base section of the hinge plate. The hinge bar is rotated in and retained in the hinge plate under all normal opening and closing operations of the bezel. However, if it is desired to remove the bezel completely from the luminaire, the bezel, when swung open from the luminaire, can be lifted such that the hinge bar is lifted out of the hinge plate after the ballast door is opened and left supported by the hinge. The bezel then is separated from the luminaire and desired repairs can be made to the bezel or luminaire. The ballast door must be opened before the bezel door can be removed from the luminaire assembly. The ballast door when in the closed position prevents the removal of the bezel door. The bezel is replaced in the reverse order by lowering the hinge bar into the hinge plate and then closing the bezel against the luminaire and then closing the ballast door.

The bending of the hinge plate toward the rear of the luminaire has proven a positive holding arrangement for the bezel. Under all opening and closing operations, the bezel remains affixed to the luminaire. The bezel is easily removed from the luminaire without tools or removal of a separate locking device.

In particular, the present invention provides a hinge for use in a luminaire, said hinge comprising a hinge plate of a generally flat cross section and of a generally hooked shape, said hinge plate having a base section affixed to a base of a luminaire, a curved middle section and a distal end section bent back toward the rear of the base of the luminaire, a hinge bar of a generally cylindrical, elongated shape affixed to a bezel section of said luminaire, said hinge bar extending generally parallel to the axis joining said luminaire and said bezel section, said hinge bar being received in said hinge plate such that said bezel section is rotatable from said luminaire base section along said hinge axis and, upon the lifting of said bezel and that said hinge bar is lifted out of said hinge plate, said bezel section being removable from said luminaire.

DESCRIPTION OF THE PREFERRED EMBODIMENT

Figure 1:
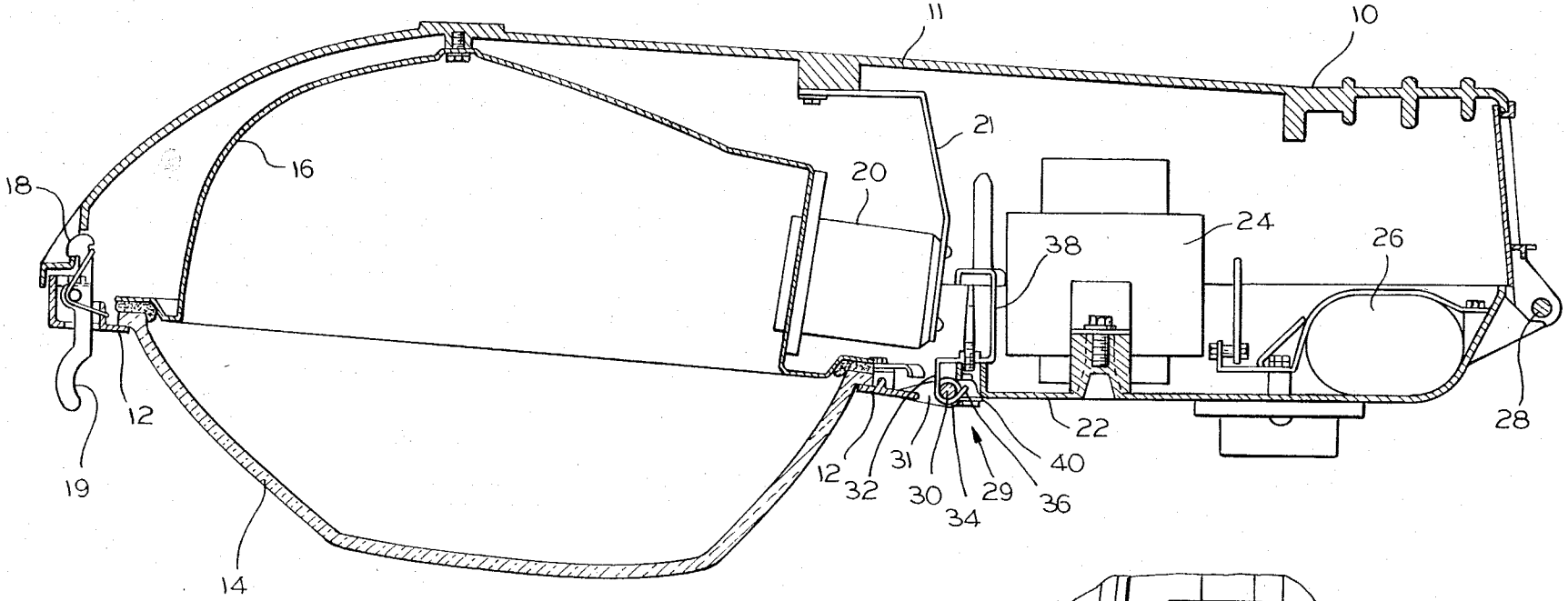
FIG. 1 is a side view in partial cross section of a luminaire employing the hinge of the present invention.
Figure 2:
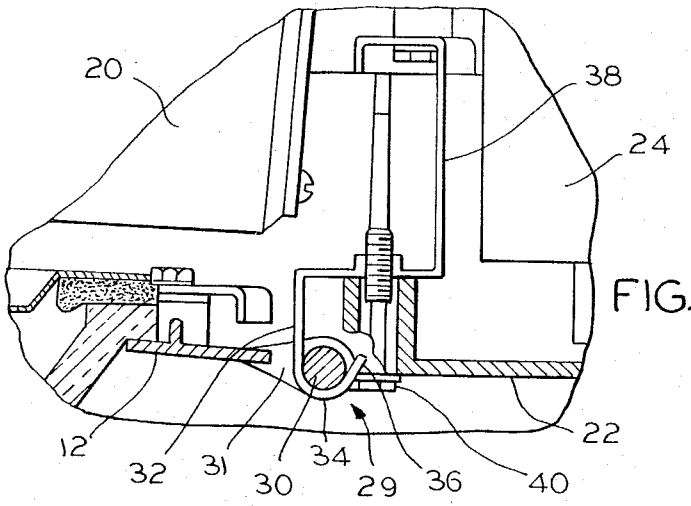
FIG. 2 is an enlarged side cross section partial view of the hinge of the present invention.
Figure 3:
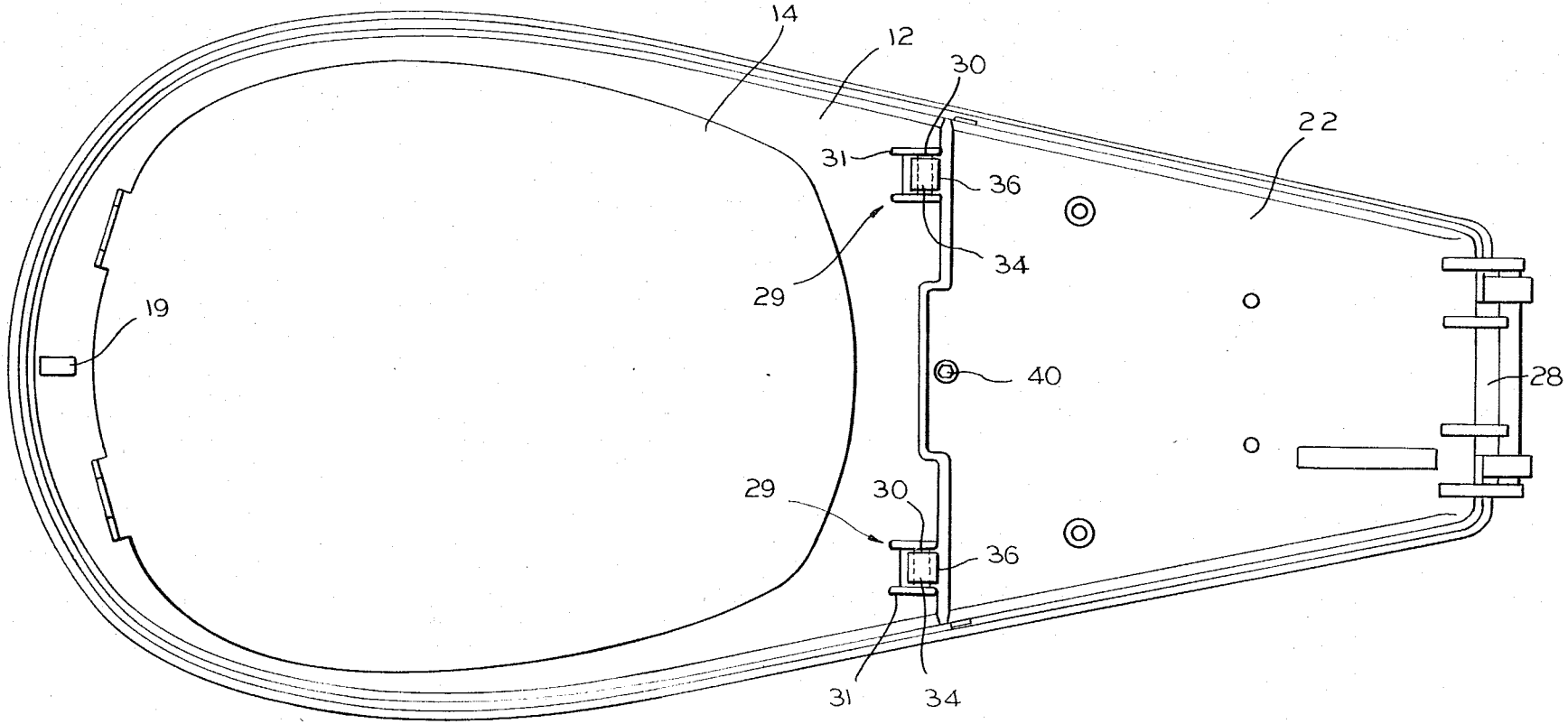
FIG. 3 is a bottom view of a luminaire employing the hinge of the present invention.

Referring now to FIGS. 1–3 of the drawings, a luminaire is shown generally at 10. Luminaire 10 is of an elongated shape and includes top metallic section 11 which has a generally open bottom. Virtually the entire bottom front section of luminaire 10 is formed by bezel door 12. Bezel door 12 has an oval opening in which reflector 14 is mounted. Bezel door 12 is usually comprised of metal, and refractor 14 is either a glass or a clear plastic. One end of bezel door 12 is held to the front portion of luminaire 10 by latch mechanism 18 which includes lever 19. The other end of bezel door 12 is supported by two hinge assemblies.

Each hinge assembly 29 includes a hinge bar 30 of a generally cylindrical shape affixed to bezel door 12 by supports 31. The other part of the hinge assembly 29 is the hinge plate that includes base section 32, curved section 34 and distal end section 36. The hinge plate is of a generally flat cross section, with base section 32 extending outwardly normal from luminaire 10 and curved section 34 forming a generally concave pocket adapted to receive hinge bar 30 therein. Distal end section 36 of the hinge plate is bent back toward the rear of the luminaire at an angle of from 120° to 180° with respect to hinge plate base section 32.

Bezel door 12 is rotatable from contact with luminaire 10 by the opening of latch mechanism 18 by the outward pulling of lever 19. Bezel door 12 will then swing open from luminaire 10 along the axis of the hinge assemblies 29. Bezel door 12 can be removed from luminaire 10 by lifting bezel door 12 such that hinge bar 30 is lifted from curved section 34 of the hinge plate and beyond distal end section 36. Bezel door 12 is replaced in the reverse manner, by placing hinge bar 30 over distal end section 36 and into curved section 34 of the hinge plate. Bezel door 12 is then swung shut by rotating about the axis of hinge assemblies 29 to the point where latch mechanism 18 is closed.

Luminaire 10 also includes extension 38 of the hinge plate which forms a structural part of the luminaire 10 base in the lower central structure of the luminaire. Lamp receptable 20 is mounted within luminaire 10 from a frame 21 hanging from top section 11 of the luminaire 10.

Ballast door 22 forms the other major portion of the bottom of luminaire 10. Ballast door 22 is hung at its rear end by hinge 28 and at its front edge by screw 40. Ballast 24 and capacitor 26 are mounted on the inside of ballast door 22.

What is claimed is:

1. A hinge comprising:

a hinge plate mounted on a first surface;

a hinge bar mounted on a second surface;

said hinge bar comprising a generally cylindrical elongated bar extending generally parallel to an axis between said first and said second surfaces;

said hinge plate comprising a flat, generally hook-shaped bar having a base section extending outwardly from said first surface, a middle section looped around said hinge bar and a distal end section extending back toward said first surface in such a manner that said second surface is hinged to said first surface but yet can be removed from said first surface by lifting said second surface such that said hinge bar is lifted out of said hinge plate.

2. The hinge of claim 1 wherein said first surface comprises a base section of a luminaire and said second surface comprises a bezel section of a luminaire.

3. The hinge of claim 1 wherein at least two hinge plates are mounted on said first surface and at least two hinge bars are mounted on said second surface.

4. A hinge for use in a luminaire, said hinge comprising:

a hinge plate of a generally flat cross section and of a generally hooked shape, said hinge plate having a base section affixed to a base of a luminaire, a curved middle section and a distal end section that back toward the rear of the base of the luminaire;

a hinge bar of a generally cylindrical, elongated shape affixed to a bezel section of said luminaire, said hinge bar extending generally parallel to the axis joining said luminaire and said bezel section;

said hinge bar being received in said hinge plate such that said bezel section is rotatable from said luminaire base section along said hinge axis and, upon the lifting of said bezel such that said hinge bar is lifted out of said hinge plate, said bezel section being removable from said luminaire.

5. The hinge of claim 4 wherein the distal end section of the hinge plate is bent back toward the rear of the base of the luminaire only to the point where the hinge bar remains removable from the hinge plate.

6. The hinge of claim 4 wherein the distal end of the hinge plate is bent back at an angle of from 120° to 180° with respect to the base section of the hinge plate.

7. A luminaire comprising:

a top section;

a bezel door mounted to close against said top section by a first hinge assembly, a ballast door mounted to close against said top section by a second hinge assembly;

said first hinge assembly including a hinge bar comprising a generally cylindrical, elongated bar extending generally parallel to a hinge axis between said top section and said bezel door, and a hinge plate comprising a flat, generally hook-shaped bar having a base section extending outwardly from said top section, a middle section looped around said hinge bar and a distal end section extending back toward said top section in such manner that said bezel door is hinged to said top section but yet can be removed from said top section by swinging open said ballast door along said second hinge assembly and then lifting said bezel door such that said hinge bar is lifted out of said hinge plate.

* * * * *